US005625400A

United States Patent [19]

Kubo

[11] Patent Number: 5,625,400

[45] Date of Patent: Apr. 29, 1997

[54] POSITIONING DEVICE FOR A DOCUMENT PROCESSING DEVICE

[75] Inventor: Hiroki Kubo, Takamatsu, Japan

[73] Assignee: Aoi Electronics Co., Ltd., Takamatsu, Japan

[21] Appl. No.: 400,081

[22] Filed: Mar. 7, 1995

[30] Foreign Application Priority Data

Mar. 11, 1994 [JP] Japan ..... 6-068075
Jun. 11, 1994 [JP] Japan ..... 6-152647

[51] Int. Cl.[6] ..... B41J 25/304
[52] U.S. Cl. ..... 347/197
[58] Field of Search ..... 347/197; 400/120.16

[56] References Cited

FOREIGN PATENT DOCUMENTS 3-75175 3/1991 Japan ..... 347/197

*Primary Examiner*—Huan H. Tran
*Attorney, Agent, or Firm*—Kanesaka & Takeuchi

[57] ABSTRACT

A positioning device for a document processing device is formed of an elongated frame having two side portions located at both ends of a center portion and bent relative to the center portion, a platen roller attached between the two side portions, a processing device attached between the two side portions and situated adjacent to the platen roller, and a fixing device for fixing the processing device to the frame. The fixing device includes two projections projecting from the processing device to engage the processing device to the side portions, a supporting point for positioning the processing device to the platen roller and a pressing member for urging the processing device to the platen roller. The platen roller and the processing device can be made thin, and can be easily assembled together.

10 Claims, 5 Drawing Sheets

Fig. 8(A)
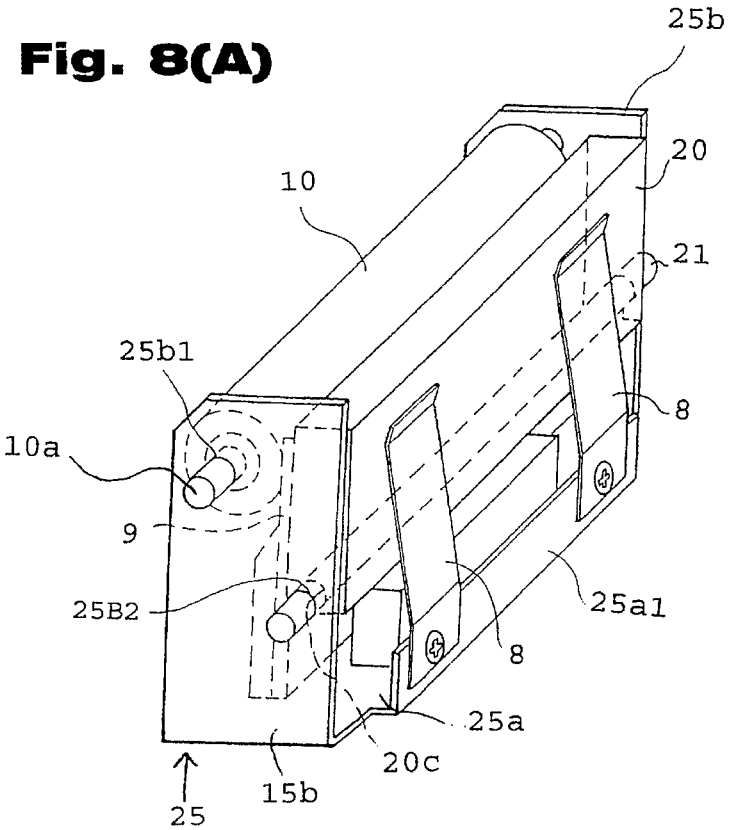
Fig. 8(B)
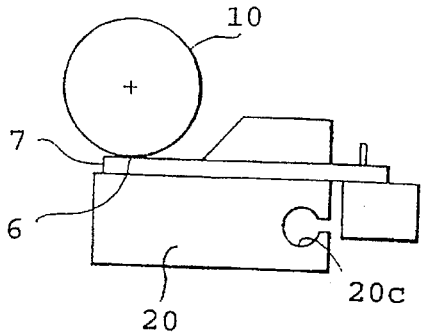
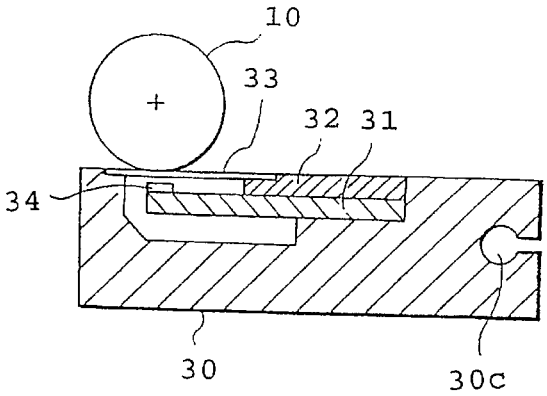
Fig. 9

POSITIONING DEVICE FOR A DOCUMENT PROCESSING DEVICE

BACKGROUND OF THE INVENTION AND RELATED ART STATEMENT

The present invention relates to a positioning device for a document processing device, more particularly, for positioning a processing device, such as a printer head, an image reading device and so on, with respect to a platen roller.

As a printing device for a facsimile, a printer and so on, a thermal head or an LED (Light Emitting Diode) head has been used. In case letters or characters are printed onto a heat sensitive paper by a thermal head, the heat sensitive paper must be pushed onto a heating section of the thermal head by a platen roller, or the heating section is pushed onto the platen roller through the heat sensitive paper. In this case, it is required to precisely position the center of the platen roller to the heating section of the thermal head.

For this purpose, as shown in FIGS. 1 and 2, a guide plate with a U-shape guide groove for a platen roller had been generally used, and attached to a support plate for constituting a heat radiating plate of the thermal head by means of screws. As shown in FIG. 1, a guide plate 1 is provided with a hole 1*a*, a positioning projection 1*b*, a supporting portion 1*c*, a fixing projection 1*d*, and a guide portion 1*e* for a platen roller 10. A support plate 2 for constituting a heat radiating plate for a thermal head includes screw holes 2*a*, and positioning holes 2*b*. The support plate 2 also includes a ceramic plate 7, a head plate 6 having a heating member 3, leading electrodes and so on, and a printed wiring board 12. When the support plate 2 and the guide plate 1 are connected, the positioning projection 1*b* is located in the positioning hole 2*b*, and a screw 5 is applied into the screw hole 2*a* through the hole 1*a*.

When the guide plate 1 with the support plate 2 is installed, the supporting portion 1*c* is located in a hole of a frame 13, and the fixing projection 1*d* is placed behind an edge of the frame 13. Springs 8 fixed on the frame urge the support plate 2, so that the guide plate 1 abuts against the edge of the frame 13. The platen roller 10 includes a shaft 10*a*, and bearing members 11 are mounted on projecting portions of the shaft 10*a*. The platen roller 10 is rotationally supported on an arm (not shown), and is inserted into the guide portions 1*e* such that the bearing members 11 are placed in the guide portions 1*e* of the guide plates 1. The platen roller 10 is moved in the guide portions 1*e* by the arm when necessary.

In the above structure, the support plate 2 requires a secondary processing for forming the screw holes 2*a*. Also, when the guide plates 1 are fixed to the support plate 2, the guide plates 1 must be precisely positioned on the support plate 2 and fixed thereto by the screws 5. Thus, the assembly work is not so efficient. Further, since the guide plates 1 are fixed to the back of the support plate 2, the thermal head is thickened to thereby enlarge the machine, which is opposite to the idea of making a compact machine.

In view of the above, thermal heads as shown in FIGS. 3 and 4 were proposed. A support plate 2A includes fixing holes 2*e* at longitudinal ends thereof, and guide plates 4 are attached to the plate 2A. Each guide plate 4 includes a guide portion 4*a*, a supporting portion 4*c*, a fixing projection 4*d*, and an inserting portion 4*f* with an engaging member 4*b*. When the plate 4 is fixed to the support plate 2A, the inserting portion 4*f* is inserted into the fixing hole 2*e*.

in FIG. 4, a support plate 2B includes fixing grooves 2*g*, 2*h*, and a guide plate 4' includes two inserting portions 4*g*, 4*h* with engaging members 4*e*, wherein the inserting portions 4*g*, 4*h* are inserted into the fixing grooves 2*g*, 2*h* to fix the guide plate 4' with the support plate 2B.

The above thermal heads can reduce the thickness, but since the guide plates for the platen rollers are laminated and fixed to the support plate, the thickness of the thermal head increases as well. Thus, the above structures do not necessarily reduce the thickness.

In a thermal head as shown in FIG. 5, a guide plate 1' includes a hole 1*a'* and a positioning projection 1*b'* as in the guide plate 1, and further includes a shaft hole 1*c'*. A support plate 2C includes screw holes 2*a* and positioning holes 2*b*. Two guide plates 1' are fixed to the support plate 2C, wherein each positioning projection 1*b'* is located in the positioning hole 2*b*, and the screw 5 is threaded into the screw hole 2*a*. Thereafter, the thermal head with the guide plates 1' is placed between side portions of a frame (not shown), and a shaft is inserted into holes of the side portions of the frame through the shaft holes 1*c'* to thereby fix the thermal head with the guide plates 1' to the frame. A platen roller 10 is rotationally fixed to the frame, as well. The shaft passing through the holes 1*c'* is positioned such that a printing head on the thermal head precisely aligns the platen roller 10. Thus, the shaft operates to align the position of the thermal head to the platen roller and to support the thermal head when the thermal head is pushed toward the platen roller for printing.

In the above structure, the guide plates 1' are fixed to the support plate 2C by the screws 5. Thus, additional processing is required for the support plate 2C, and also, the screws 5 and the flanges for the holes 1*c'* project from the thermal head to thereby increase the thickness of the thermal head. Therefore, the thermal head of FIG. 5 can not be made compact, as in the prior art shown in FIGS. 1–4.

Accordingly, the present invention has been made to obviate the drawbacks in the conventional processing device, such as thermal heads, and has an object to provide a positioning device for a document processing device, such as a printer head, an image reading device and so on, wherein the processing device can be easily and precisely positioned relative to a platen roller.

Another object of the invention is to provide a positioning device as stated above, wherein a processing for a support plate required for positioning the processing device to the platen roller is minimized.

A further object of the invention is to provide a positioning device as stated above, wherein the processing device can be made simple and compact.

A still further object of the invention is to provide a positioning device as stated above, which can be manufactured easily and economically.

SUMMARY OF THE INVENTION

A positioning device for a document processing device of the invention basically comprises an elongated frame having two side portions located at both ends of a center portion and bent relative to the center portion, a platen roller attached between the two side portions, a processing device attached between the two side portions and situated adjacent to the platen roller, and fixing means for fixing the processing device to the frame. The fixing means includes two projections projecting from the processing device to engage the processing device to the side portions, a supporting point for positioning the processing device to the platen roller and a pressing member for urging the processing device to the platen roller.

In a first aspect of the positioning device of the invention, the frame includes L-shaped guide grooves formed in the respective side portions of the elongated frame, in which the projections are located to position the processing device adjacent to the platen roller. Also, the frame includes roller guide grooves facing the guide groove for the projections. The platen roller supported by an arm is movably situated in the roller guide grooves to face the processing device.

In a second aspect of the positioning device of the invention, the platen roller is rotationally fixed to the side portions, and the processing device is also pivotally fixed to the side portions by the projections. One side of the processing device away from the projections is urged by the pressing member to the platen roller.

The processing device may be a printing head for printing letters and characters on a sheet disposed between the processing device and the platen roller, or an image reading device for reading an image on a sheet disposed between the processing device and the platen roller.

BRIEF DESCRIPTION OF THE DRAWINGS

FIG. 8(A) is a perspective view of a second embodiment of a positioning device of the invention;

FIG. 8(B) is an explanatory side view of the second embodiment; and

FIG. 9 is a side view of a modified example of FIG. 8.

DETAILED DESCRIPTION OF PREFERRED EMBODIMENTS

The present invention will be explained with references to FIGS. 6–9, wherein members explained already in the prior art have the same numerals and explanation thereof is omitted.

Figure 1:
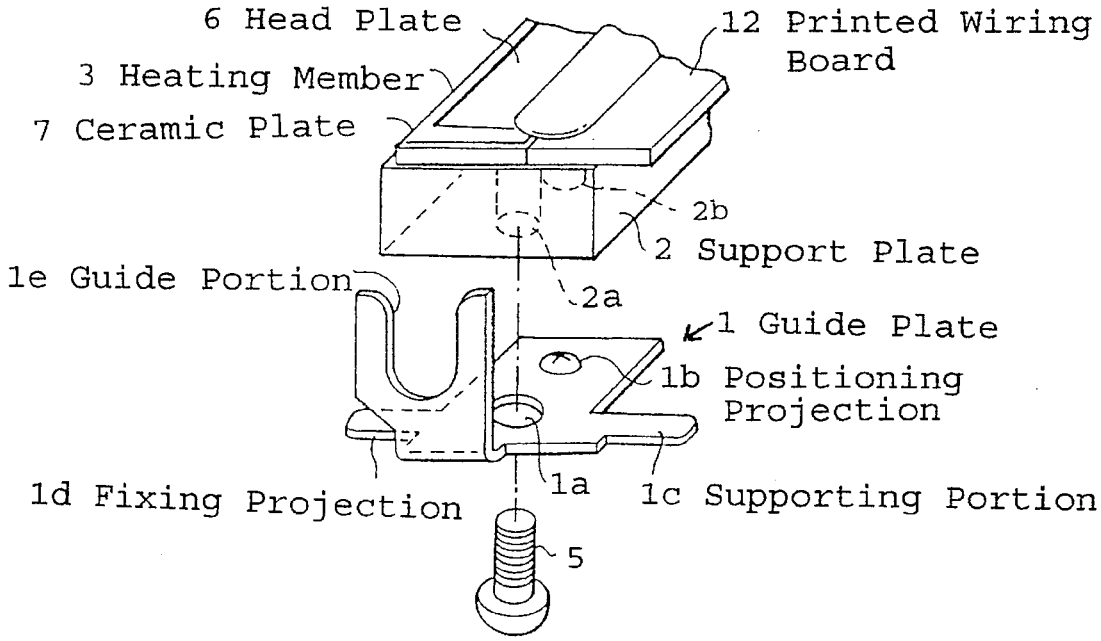
Fig. 1 PRIOR ART
FIG. 1 is an exploded perspective view of a part of a conventional printer head with a guide plate.
Figure 2:
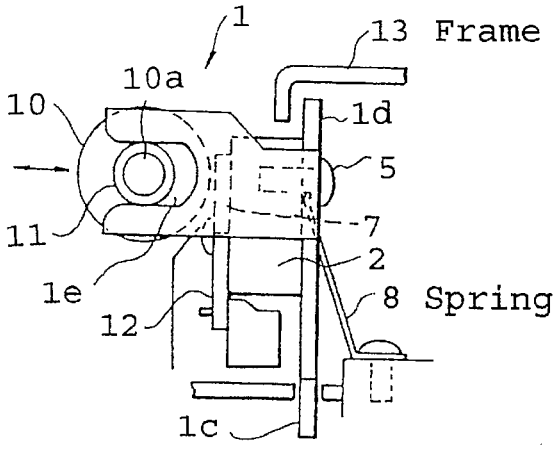
Fig. 2 PRIOR ART
FIG. 2 is a side view of the printer head and the guide plate of FIG. 1 in an assembled condition.
Figure 3:
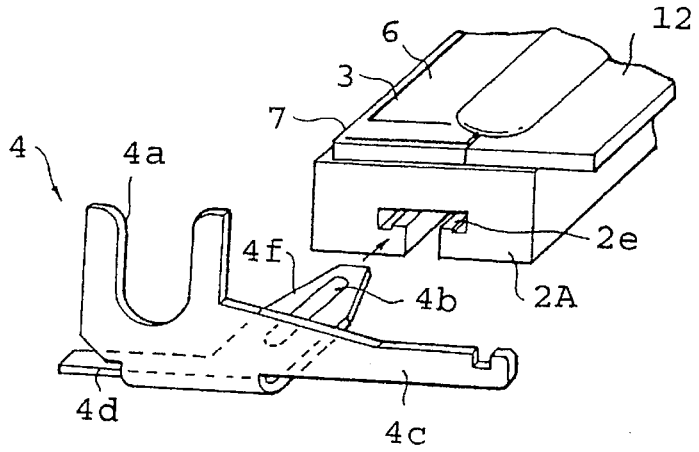
Fig. 3 PRIOR ART
FIGS. 3 and 4 are explanatory perspective views of parts of conventional printer heads with guide plates.
Figure 4:
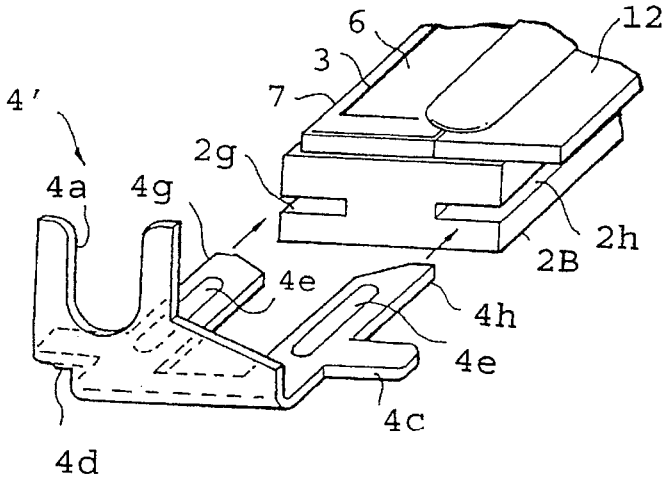
Fig. 4 PRIOR ART
Figure 5:
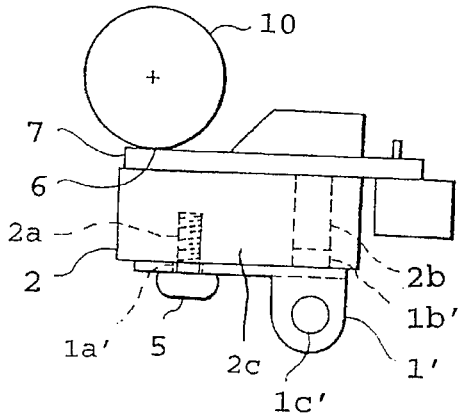
Fig. 5 PRIOR ART
FIG. 5 is an explanatory side view of a still different conventional printer head and a guide plate.
Figure 6:
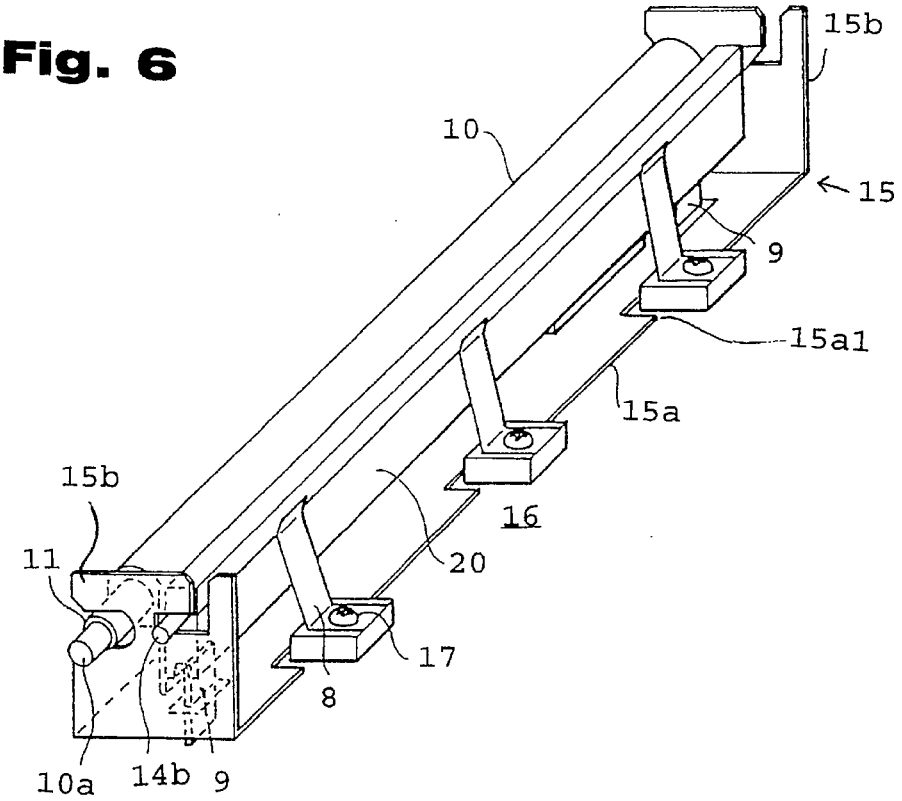
FIG. 6 is a perspective view of a first embodiment of a positioning device of the invention with a printer head and a platen roller.
Figure 7A:
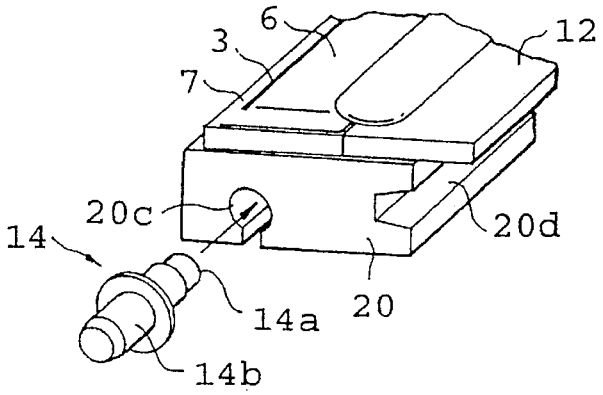
FIG. 7(A) is an explanatory enlarged perspective view of a part of the printer head.
Figure 7B:
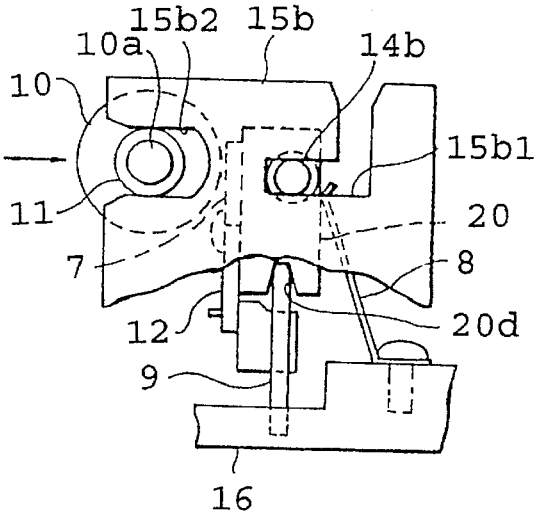
FIG. 7(B) is a partly cut side view of the positioning device of FIG. 6.

A first embodiment of the invention is shown in FIGS. 6, 7(A) and 7(B). In the invention, a support plate 20 for a thermal head similar to and explained in FIG. 1 and a platen roller 10 are assembled by an elongated frame 15 formed of a center portion 15*a* and side portions 15*b*.

The center portion 15*a* includes three notches 15*a*1 for receiving springs 8 fixed to a base 16 of a printer by screws 17. The side portion 15*b* includes an L-shaped groove 15*b*1 extending from an upper end thereof, and a groove 15*b*2 facing a horizontal part of the groove 15*b*1. The platen roller 10 includes a shaft 10*a* projecting laterally therefrom, and bearings or sleeves 11 are disposed on the projecting portions of the shaft 10*a*. The shaft 10*a* is rotationally attached to arms (not shown) pivotally fixed to the base 16. When the arms are moved, the platen roller 10 is disposed between the side portions 15*b*, and the sleeves 11 are located in the respective grooves 15*b*2 of the side portion 15*b*.

The support plate 20 for the thermal head includes at longitudinal ends thereof circular slits 20*c* and grooves 20*d*. Guide pins 14 each having an insertion portion 14*a* are pushed into the circular slits 20*c*, so that projecting portions 14*b* of the guide pins 14 project outwardly from the support plate 20. The projecting portions 14*b* of the guide pins 14 are inserted into the grooves 15*b*1 of the side portions to locate the thermal head onto the frame 15. Accordingly, a heating portion 3 on the support plate 20 can be aligned to the platen roller 10. The thermal head and the platen roller 10 can be precisely aligned by precisely forming the grooves 15*b*1, 15*b*2.

When the frame 15 with the thermal head is fixed to the base 16, the frame 15 is placed onto the base 16, so that support plates 9 fixed to the base 16 pass through holes of the frame 15 and are disposed in the grooves 20*d*. When the support plate 20 is pushed by the springs 8 toward the platen roller 10, a contact portion between the support plate 9 and the groove 20*d* forms a supporting point.

In the embodiment, as shown in FIG. 7(B), the support plates 9 are fixed to the base 16, and extend through the holes of the frame 15 to engage the grooves 20*d*. However, the support plates may be fixed to the frame 15. Also, the springs 8 may be fixed to the frame 15 as well.

When the thermal head is used, the heating portion 3 is pushed to the platen roller 10 through a heat sensitive paper. When the heat sensitive paper is exchanged, the thermal head has to be moved away from the platen roller 10. In this case, even if the guide pins 14 are moved or pushed rearwardly, the guide pins 14 do not disengage from the grooves 15*b*1 because of L-shape.

The support plate 20 of the thermal head is made of aluminum and formed by drawing or extruding a long metal. Thus, the support plate 20 can be formed easily. Also, the support plate 20 and the circular groove 20*c* may have different shapes. Further, the frame 15 may be formed of one metal sheet by pressing. Thus, the grooves 15*b*1, 15*b*2 can be precisely formed in the frame 15.

FIGS. 8(A) and 8(B) show a second embodiment of the invention, wherein a platen roller 10 and a support member 20 for a thermal head are attached to a frame 25 having a central portion 25*a* and side portions 25*b*. Namely, a shaft 10*a* of the platen roller 10 is rotationally retained in holes 25*b*1 and held between the side portions 25*b*.

The support member 20 includes a circular groove 20*c* along the longitudinal direction thereof. A shaft 21 is located in the groove 20*c* so that the ends of the shaft 21 project outwardly therefrom. When the support member 20 is assembled with the frame 25, the support member 20 is located between the side portions 25*b*, and the shaft 21 is inserted into holes 25*b*2 of the side portions 25*b* and the circular groove 20*c*. The thermal head can be rotated around the shaft, and can be precisely aligned with the platen roller 10 rotationally attached to the frame 25. In order to push the thermal head to the platen roller 10, springs 8 are fixed to a flange 25*a*1 of the frame 25. In use, a heat sensitive paper is located between the thermal head and the platen roller 10.

In the above structure, the shaft 21 is simply inserted into the groove 20*c* through the side portions of the frame, so that the thermal head can be easily attached to the frame 25. The thickness of the thermal head-need not be increased. Since the support member 20 is made of aluminum, the shape of the support member 20 can be formed easily.

A modified example is shown in FIG. 9, wherein an image reading device is combined with a platen roller 10. The image reading device is formed of a support plate 30, a head plate 31 fixed to the support plate 30, light receiving means 34, a support plate 32, a glass cover 33 and so on. The light receiving means 34 and the support plate 32 are disposed on the head plate 31, and the glass cover 33 is located between the support plates 30, 32. A document is situated between the platen roller 10 and the glass cover 33, and while the document is moved on the glass cover 33 by the platen roller 10, the light receiving means 34 reads characters or images on the document.

The support plate 30 is provided with a circular groove 30*c* parallel to the light receiving means 34. The support plate 30 is situated between the side plates 25*b* of the frame 25, and is supported by the shaft 21, as shown in FIG. 8(A). The support plate 30 is located so that the center of the platen roller 10 aligns the light receiving means 34.

In the above examples, the circular grooves are formed in the support plate 30, but a circular hole may be formed. Also, the thermal head is placed on the support plate, but the LED head or other means may be attached on the support plate.

In the present invention, the document processing device, such as the printing head and the image reading device, can be easily and precisely aligned with respect to the platen roller. Also, the thickness of the processing device can be made thin, and secondary processing for the support plate for the processing device be eliminated.

While the invention has been explained with reference to the specific embodiments of the invention, the explanation is illustrative and the invention is limited only by the appended claimed.

What is claimed is:

1. A positioning device for a document processing device, comprising, an elongated frame having a center portion, two side portions located at both ends of the center portion and bent relative to the center portion, and guide grooves formed in the respective side portions, a platen roller attached between the two side portions, a processing device attached between the two side portions and situated adjacent to the platen roller, said processing device having support grooves at one side thereof, and fixing means for fixing the processing device to the frame and including two projections projecting from the processing device at portions away from the support grooves to engage the processing device to the side portions, said projections being located in the guide grooves to position the processing device to the platen roller, a supporting point for positioning the processing device to the platen roller, said support grooves forming the supporting point for the processing device, and a pressing member for urging the processing device to the platen roller.

2. A positioning device according to claim 1, wherein said guide grooves are L-shaped grooves and having ends, said processing device being pushed by the pressing member to allow the projections to be located close to the ends.

3. A positioning device according to claim 2, wherein said frame further includes roller guide grooves facing the guide grooves for the projections, said platen roller being movably situated in the roller guide groove to face the processing device.

4. A positioning device according to claim 3, wherein said fixing means further includes support plates engaging the support grooves, said support plates, said elongated frame and said pressing means being fixed to a main frame.

5. A positioning device according to claim 4, wherein said projections are pins fixed to the processing device.

6. A positioning device for a document processing device, comprising, an elongated frame having a center portion, and two side portions located at both ends of the center portion and bent relative to the center portion, a platen roller rotationally situated between the two side portions, a processing device rotationally situated between the two side portions and disposed adjacent to the platen roller, said processing device having side ends facing the side portions of the frame and a circular groove extending between the side ends and situated at one side thereof, said circular groove extending inwardly from one side wall of the processing device, and fixing means for fixing the processing device to the frame and including two projections projecting from the circular groove of the processing device to rotationally engage the processing device to the side portions, a supporting point for positioning the processing device to the platen roller, and a pressing member for urging the processing device to the platen roller at the other side of the processing device.

7. A positioning device according to claim 6, wherein said projections are ends of a shaft extending through the circular groove of the processing device, said shaft constituting the supporting point of the fixing means.

8. A positioning device according to claim 7, wherein said pressing member includes a plurality of spring plates fixed to the center portion of the frame.

9. A positioning device according to claim 8, wherein said processing device is one of a printing head for printing on a sheet, and an image reading device for reading an image on a sheet.

10. A positioning device according to claim 6, wherein said circular groove includes a circular hollow portion and a groove portion, the diameter of the circular hollow portion being greater than the width of the groove portion.

* * * * *